US009664467B2

(12) United States Patent
Christenson

(10) Patent No.: US 9,664,467 B2
(45) Date of Patent: May 30, 2017

(54) GAS KEY

(71) Applicant: Marc Christenson, Glenview, IL (US)

(72) Inventor: Marc Christenson, Glenview, IL (US)

(73) Assignee: D.S. Arms, Incorporated, Lake Barrington, IL (US)

( * ) Notice: Subject to any disclaimer, the term of this patent is extended or adjusted under 35 U.S.C. 154(b) by 278 days.

(21) Appl. No.: 13/717,335

(22) Filed: Dec. 17, 2012

(65) Prior Publication Data

US 2014/0060311 A1 Mar. 6, 2014

Related U.S. Application Data

(60) Provisional application No. 61/576,716, filed on Dec. 16, 2011.

(51) Int. Cl.
*F41A 3/00* (2006.01)
*F41A 5/18* (2006.01)

(52) U.S. Cl.
CPC ..... *F41A 5/18* (2013.01)

(58) Field of Classification Search
USPC ..... 89/19.01, 19.02, 179, 192, 19; 42/16
See application file for complete search history.

(56) References Cited

U.S. PATENT DOCUMENTS

2009/0120277 A1* 5/2009 Adams ..... 89/179
2012/0260553 A1* 10/2012 Gnesda et al. ..... 42/16

* cited by examiner

*Primary Examiner* — J. Woodrow Eldred
(74) *Attorney, Agent, or Firm* — James Faier; Martin Faier; Faier & Faier

(57) ABSTRACT

An improved gas key assembly for a fire arm, such as an AR 15 or a M4 rifle, having a gas key fastened by fasteners on a bolt carrier assembly where the gas key moves with the bolt carrier when the fire arm is fired, wherein the gas key has a slot for receiving a key element in the slot and the key element has a stem which is seated in the slot and a rail which overlays the fasteners to removably secure the gas key to the bolt carrier and holds gas key resisting unintended separation of the gas key from the bolt carrier. Also the invention includes a method for securing a gas key to a bolt carrier in such a fire arm.

12 Claims, 14 Drawing Sheets

GAS KEY

PRIORITY CLAIM

Priority is claimed on U.S. Provisional Patent Application Ser. No. 61/576,716, filed Dec. 16, 2011.

BACKGROUND OF THE INVENTION

At this time, the number one complaint of AR15 and M4 rifle users is that the gas key separates from the bolt carrier. The result is that the rifle ceases to fire. The gas key and bolt carrier, known jointly as the bolt carrier assembly or carrier assembly, separate because the screws that hold the gas key to the bolt carrier loosen over time as the rifle is fired. The original equipment screws are typically hex bolts. The gas key is drilled to accept two screws through two holes on the top of the gas key. The gas key is made with concavities so that the heads of the hex bolts are recessed. When fired, the bolt carrier assembly travels in the firing chamber ejecting the round and resetting the hammer under substantial force.

Many AR15 users undertake staking the gas key. When staking, the user would buy staking device and would seek to stake the gas key in mounting recesses to prevent the hex bolts from backing out. Unfortunately, the forces at work in the fire arm carrier assembly nonetheless push out the hex bolts.

The present invention cures the problem of the fasteners backing out while allowing the bolt carrier and gas key to be taken apart for maintenance, which is required from time to time.

Bolt carrier groups are made by numerous manufacturers. Some manufacturers stake the bolts holding the gas key to the bolt carrier. Staking a gas key and the bolts pinches the material on the gas key to the bolts and inhibits the bolts from turning and backing out. The problem with such staking is that sometimes the bolts need to be loosened to maintain the gas key or the bolt carrier or to repair the fire arm.

Some users have sought to inhibit back out of the gas key bolts by applying a cement-type material, such as "LOCTITE." Such cement products are not a solution to the problem because of the hot gasses liberated in the firing chamber during the firing of the AR15 or M4 affect the cement material and the bolts still become loose or there can be other adverse effects. The bolt reciprocates during firing, and this reciprocating action produces great force on the gas key, which further complicates retention of the gas key on the bolt carrier.

SUMMARY OF THE INVENTION

The solution to the problem is a change in the fastener configuration that takes into account the functionality of the bolt carrier assembly, the environment of the firing chamber, and the stresses on the fasteners. Presently, the gas key is fitted with two hex bolts separated forward and aft by about two centimeters. In one embodiment, the two hex bolts used to attach the gas key to the bolt carrier have been cut to provide each hex bolt with a flat edge on one side of the hex bolt head parallel to the shaft of the hex bolt. The gas key is slotted with a keyway transverse to its longitudinal direction with a channel to expose the flat edge of each hex bolt. The slot is perpendicular to the long dimension of the gas key. A key element slides snuggly into the keyway slot such that the long edge of the key element abuts the flat edge of each fastener. Also, the key element has an elongated section or rail forward and aft of the slot that extends over at least part of each hex bolt. The key element is dimensioned so that it will not interfere with the travel of the gas key when the rifle is fired. The key element holds the hex bolts by both stopping the flat edge of the hex bolt from turning and by blocking the path of a loosening hex bolt. The key element may be removed from the keyway so that the gas key, bolt carrier, and hex bolts may be replaced or maintained.

DESCRIPTION OF THE PREFERRED EMBODIMENT

The preferred embodiment of the invention requires a Gas Key to be fabricated that has a keyway Channel cut into the Gas Key to receive the key element, which may be in the shape of a Dovetail. In the preferred embodiment, the key element is somewhat "T" shaped with a Stem vertical member and a Rail horizontal member. The Stem is trapezoidal in shape. The keyway Channel is made to receive snuggly the key element. In the preferred embodiment, the bottom edges of the keyway Channel are wide enough that they open into Fore Hex Bolt Receiving Hole and the Aft Hex Bolt Receiving hole. In the preferred embodiment, each Hex Bolt would be tightened so that a flat edge of the Hex bolt would run parallel and in line with one of the edges of the keyway Channel. When the key element is set in place, an edge of the Stem of the key element presses against a flat edge of a Hex Bolt, thereby stopping the Hex Bolts from turning and thereby loosening. Additionally, the Rail of the key element at least partially covers the Fore Hex Bolt Receiving Hole and the Aft Hex Bolt Receiving Hole preventing a Hex Bolt from backing out of its socket. The Rail Top is curved and of a size that it operates within the standard AR 15/M4 receiver.

DETAILED DESCRIPTION OF THE DRAWINGS

Figure 1:
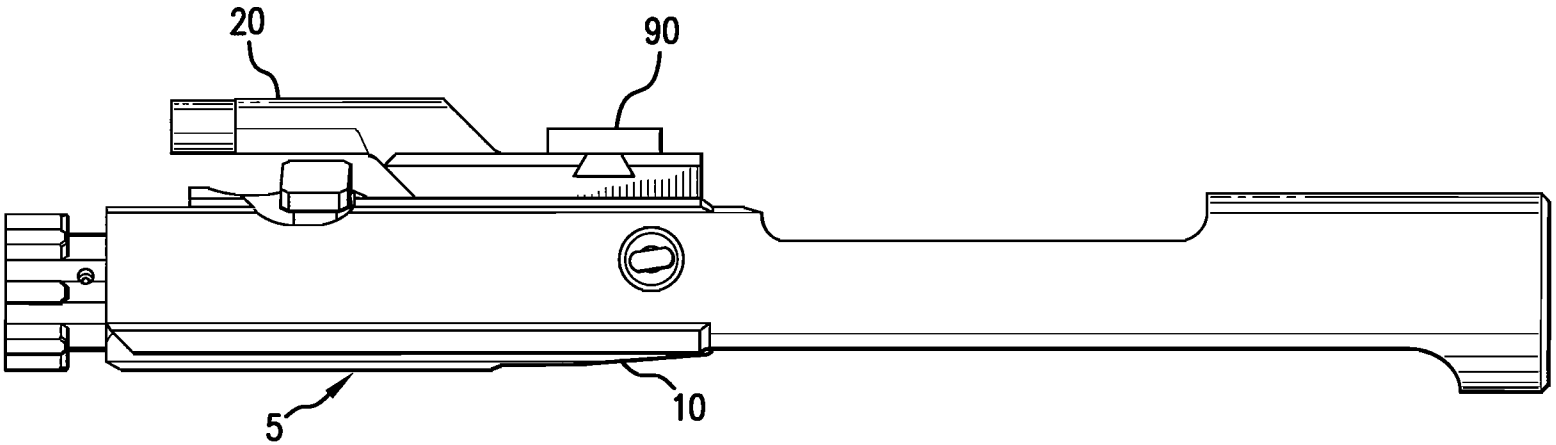
FIG. 1 is a right side view of the bolt carrier assembly.
Figure 2:
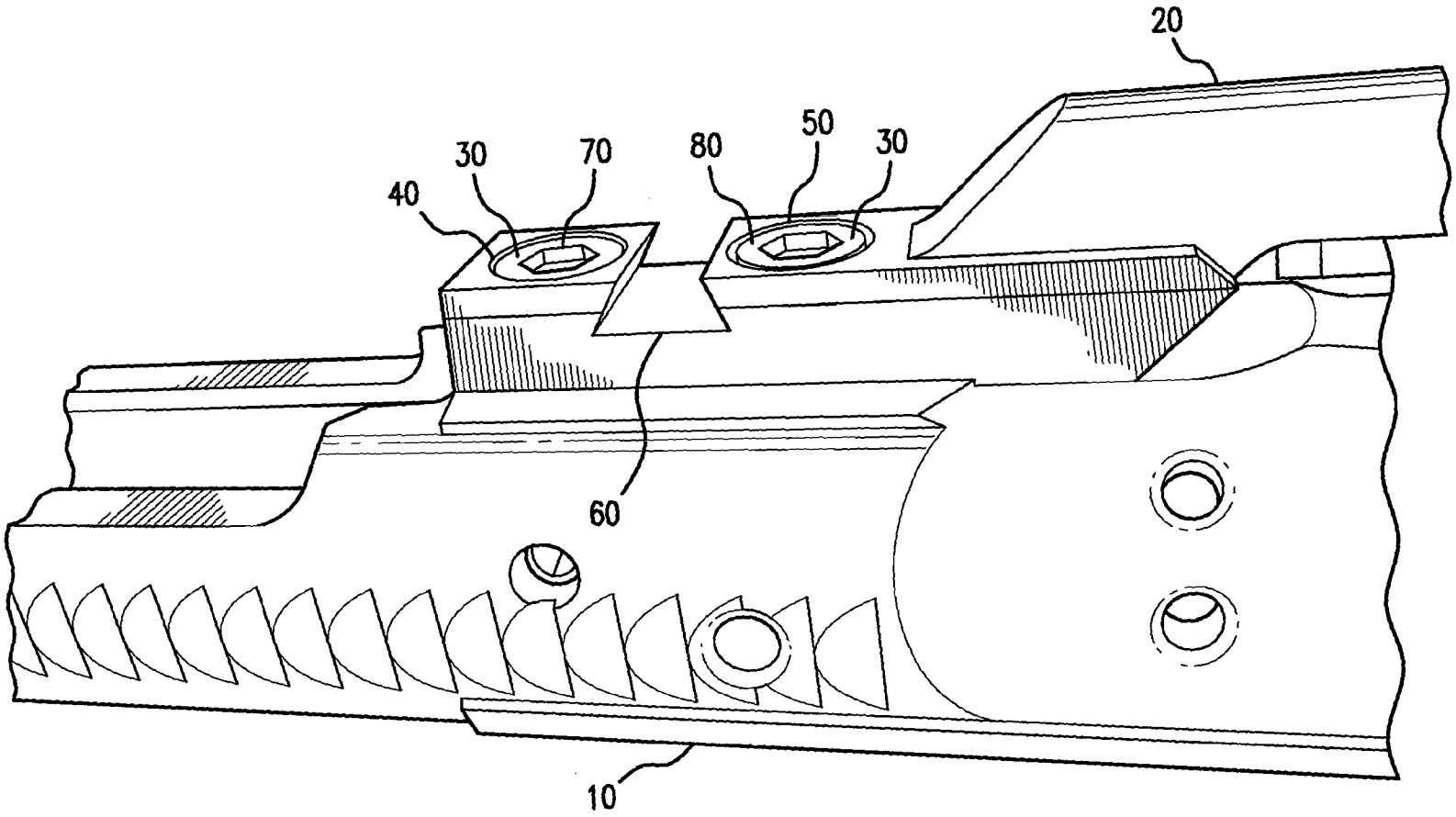
FIG. 2 is a perspective view of part of the bolt carrier assembly showing a portion of the gas key secured to the bolt carrier barrel.
Figure 3:
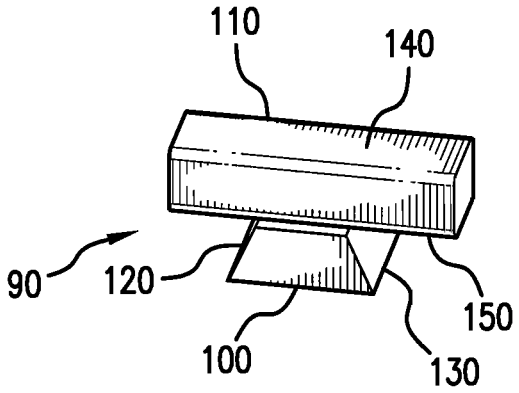
FIG. 3 is a perspective view of the key element embodying the present invention.
Figure 4:
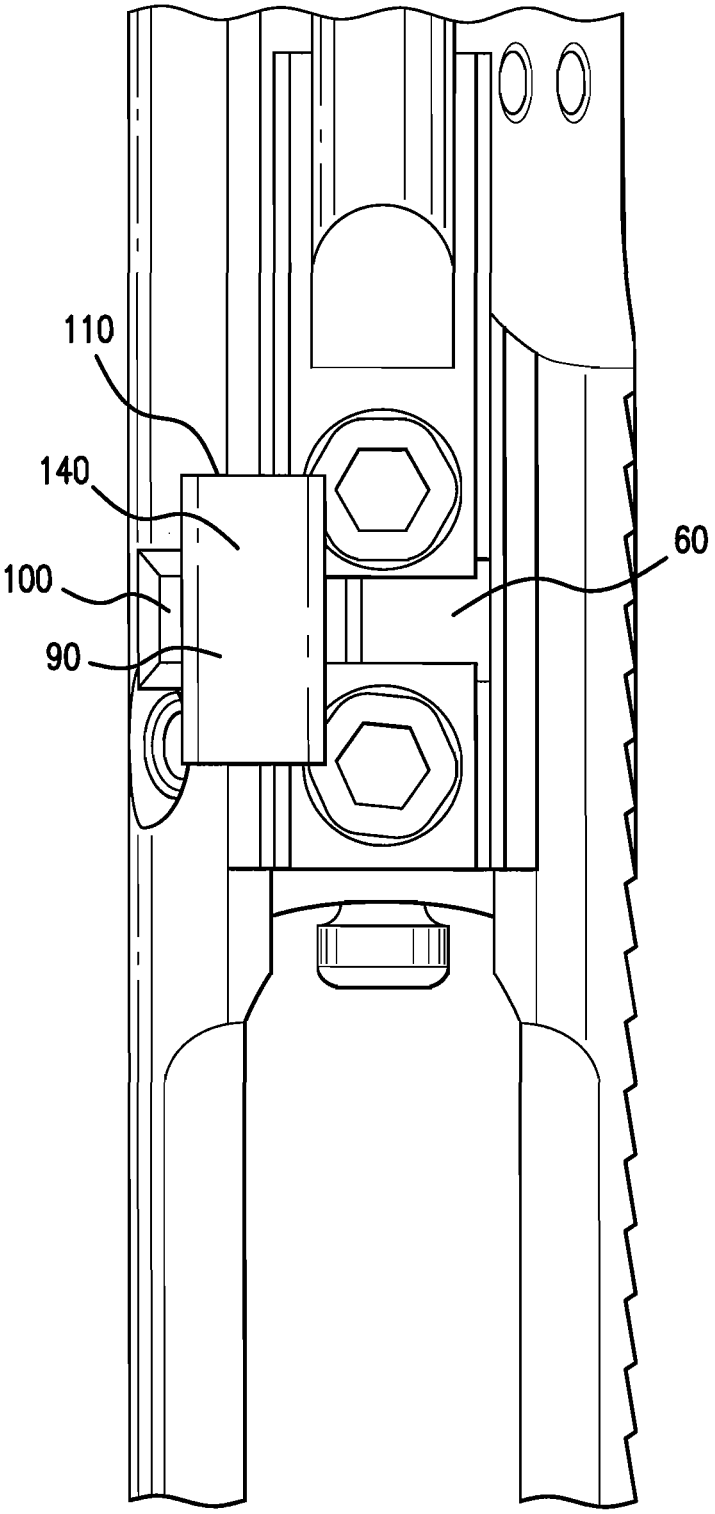
FIG. 4 is a top view of part of the gas key secured to the bolt carrier barrel, with the key element partially set in the keyway channel and with the rail of the key element partially covering the hex bolt fasteners.
Figure 5:
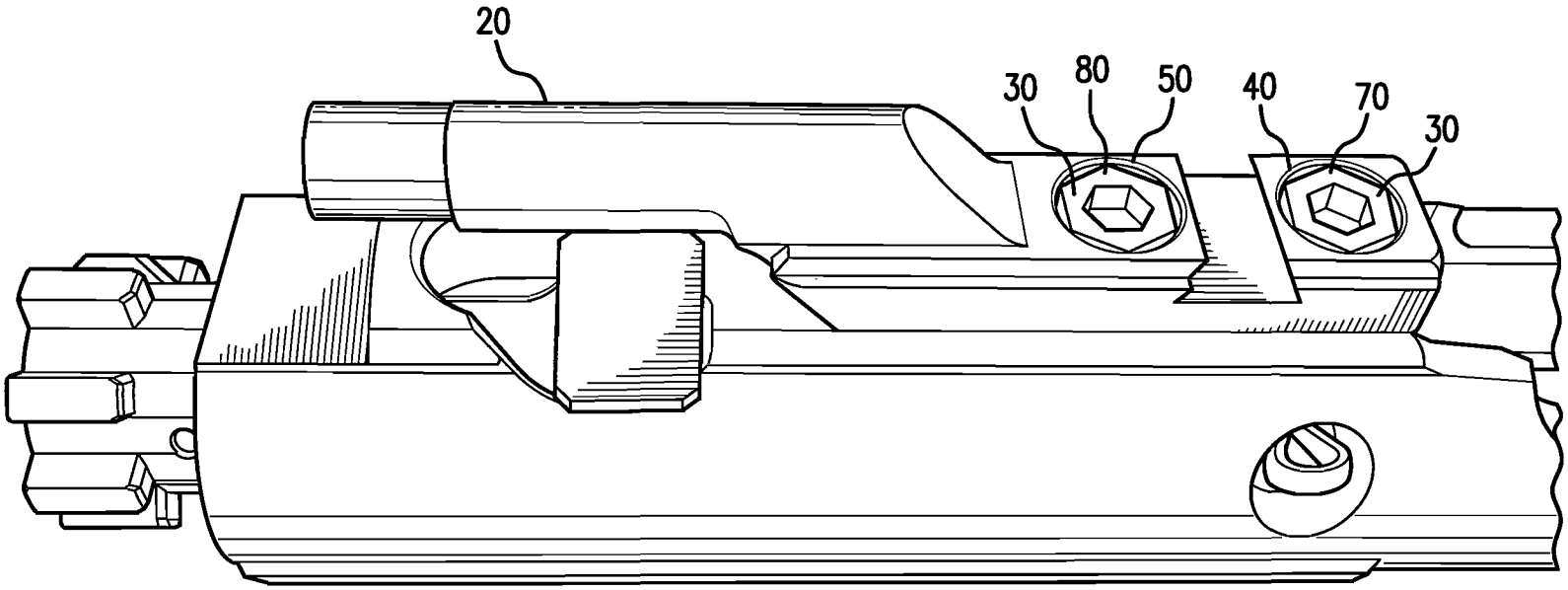
FIG. 5 is an enlarged perspective view of part of the bolt carrier barrel without the key element set into place and showing the keyway channel and the hex bolts.
Figure 6:
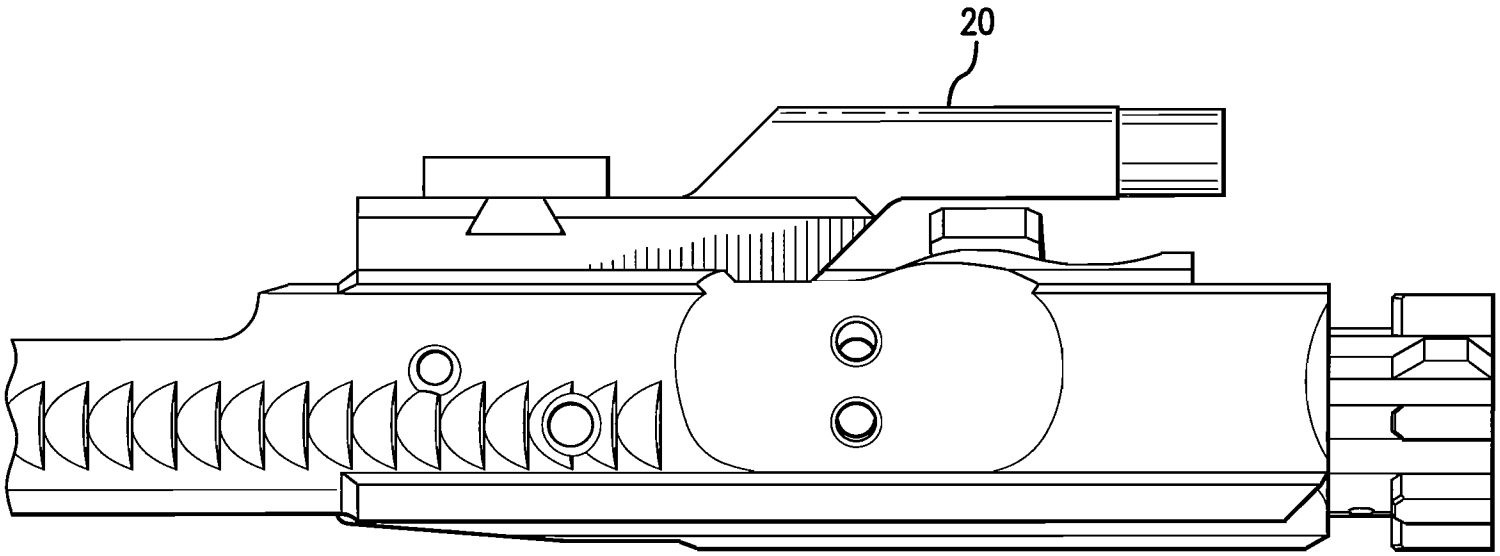
FIG. 6 is right side view of part of the bolt carrier barrel with the key element set in place in the keyway channel.
Figure 7:
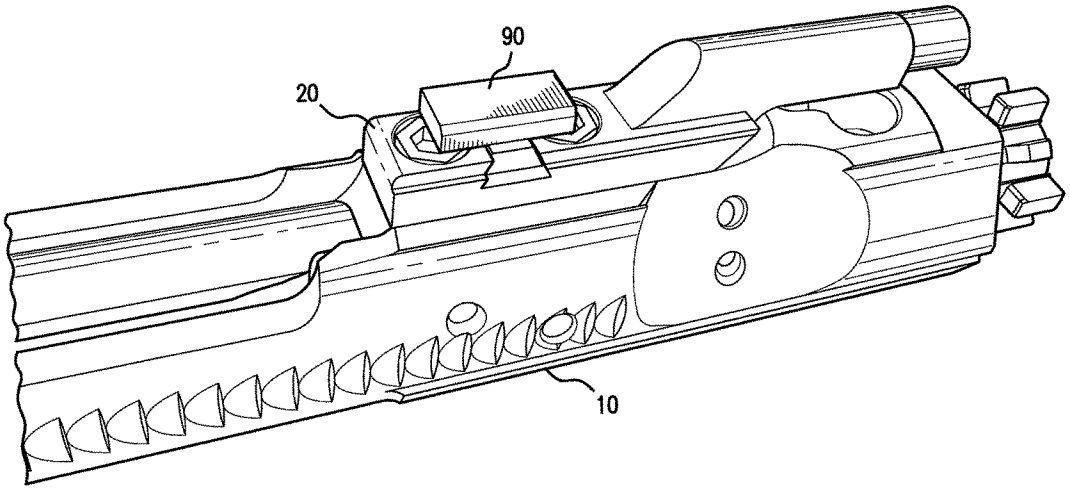
FIG. 7 is a right side perspective view of part of the bolt carrier barrel with the key element set into the keyway channel and covering the hex bolt fasteners.
Figure 8:
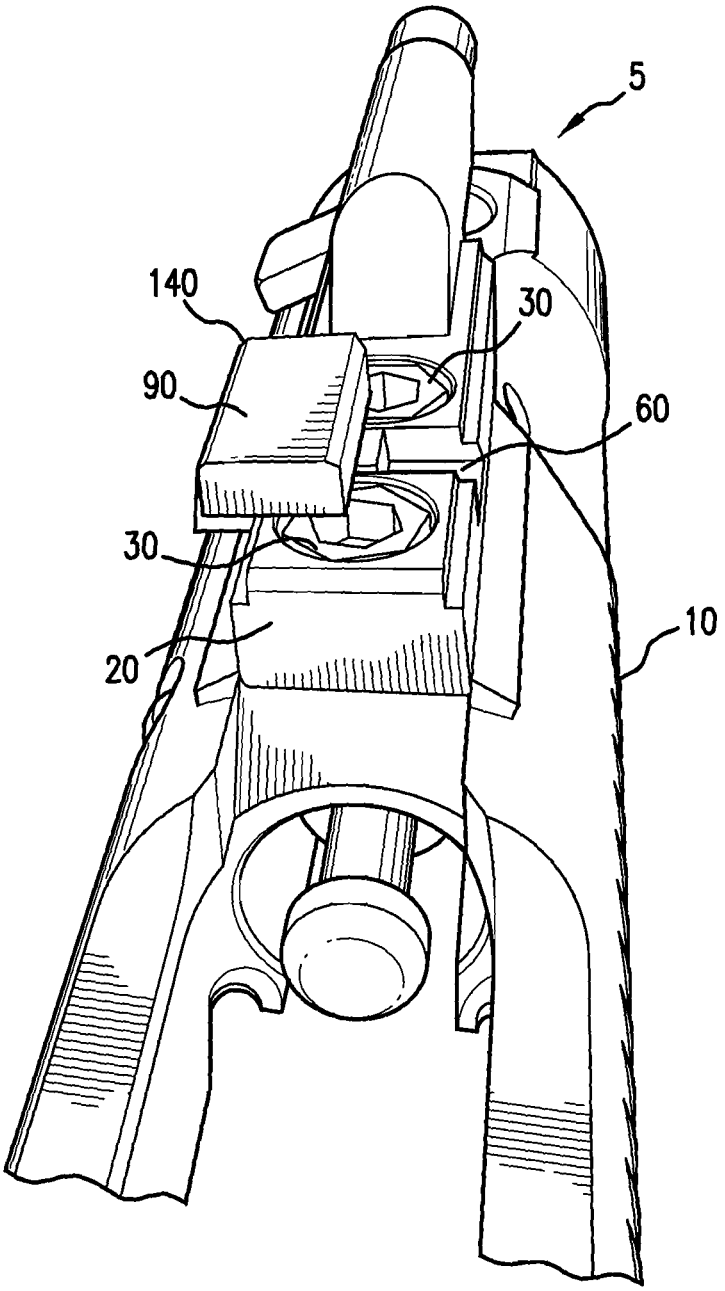
FIG. 8 is a rear perspective view of the gas key partially overlying the bolt carrier barrel showing the key element entering the channel to overlay the hex bolt fasteners.
Figure 9:
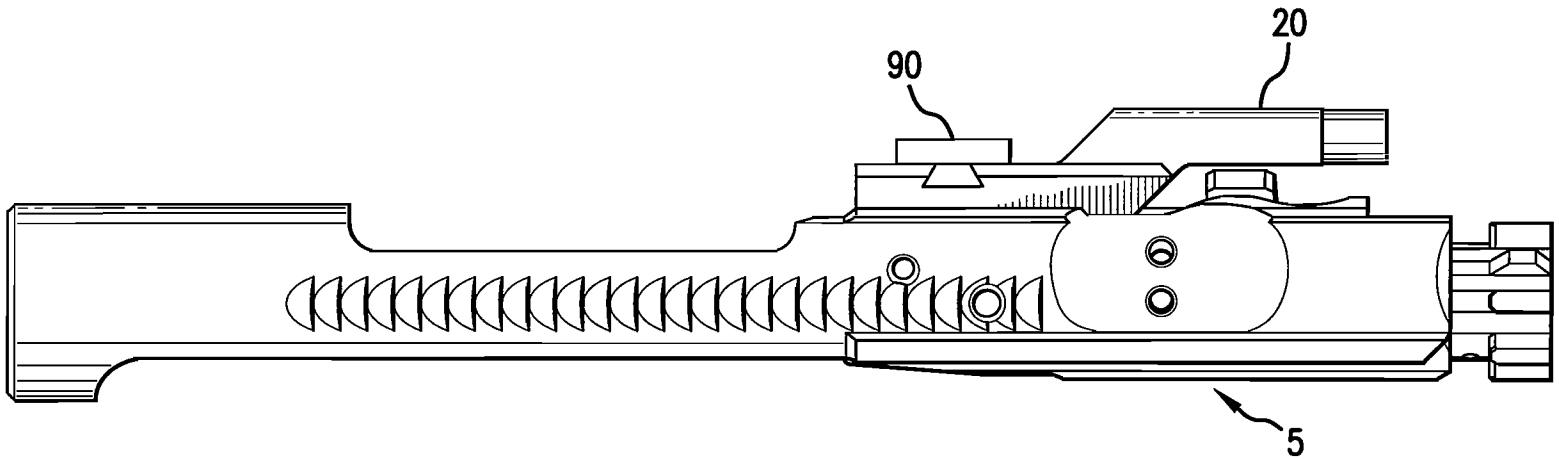
FIG. 9 is a left side view of the bolt carrier assembly showing the gas key secured to the bolt carrier barrel and the key element set in the keyway channel on the gas key.
Figure 10:
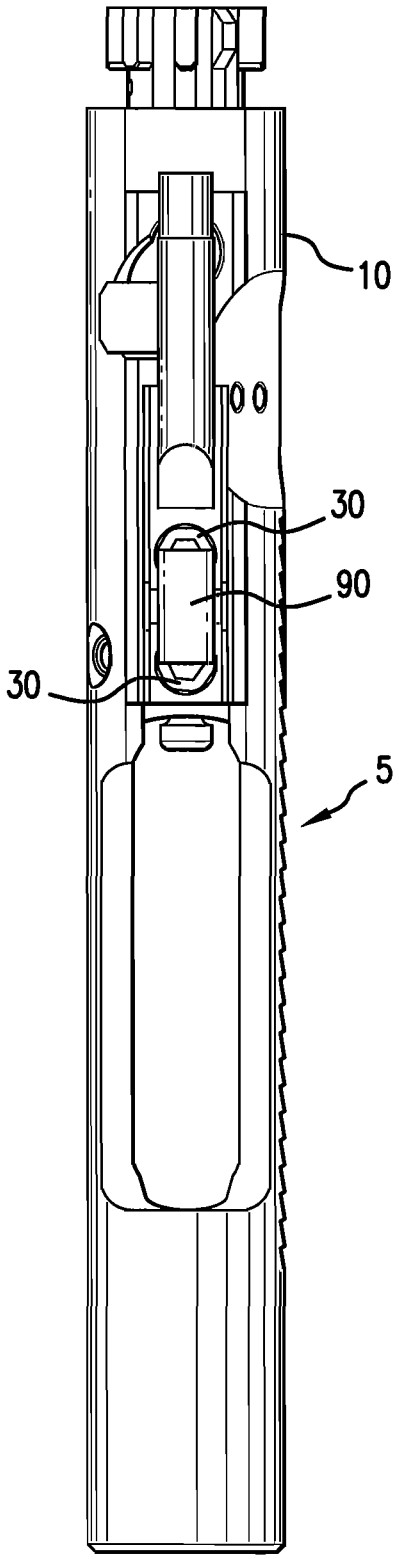
FIG. 10 is a top view of the bolt carrier assembly with the gas key secured to the bolt carrier barrel.
Figure 11:
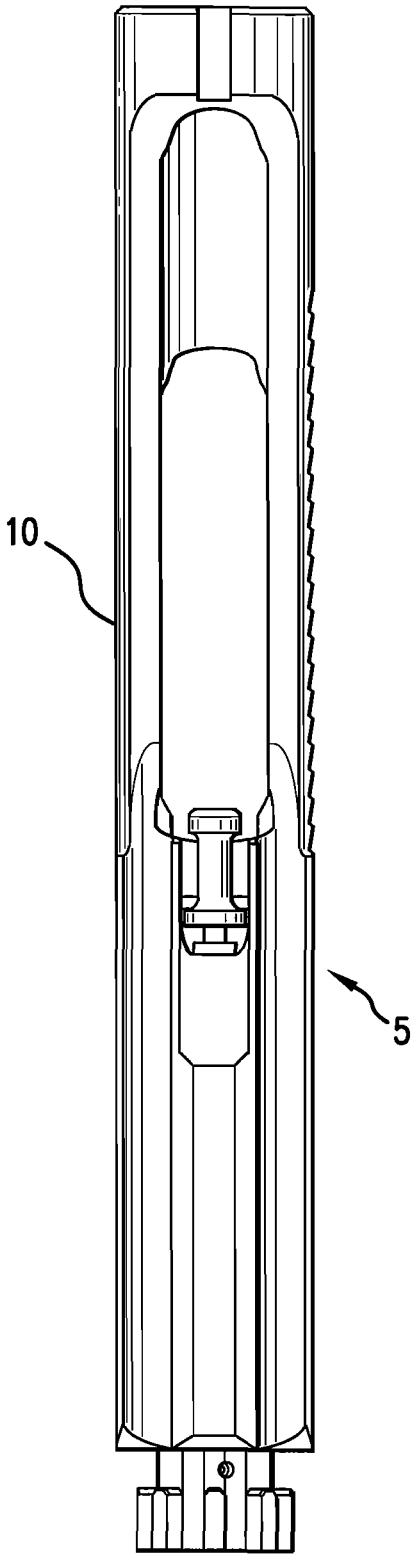
FIG. 11 is a bottom plan view of the bolt carrier assembly.
Figure 12:
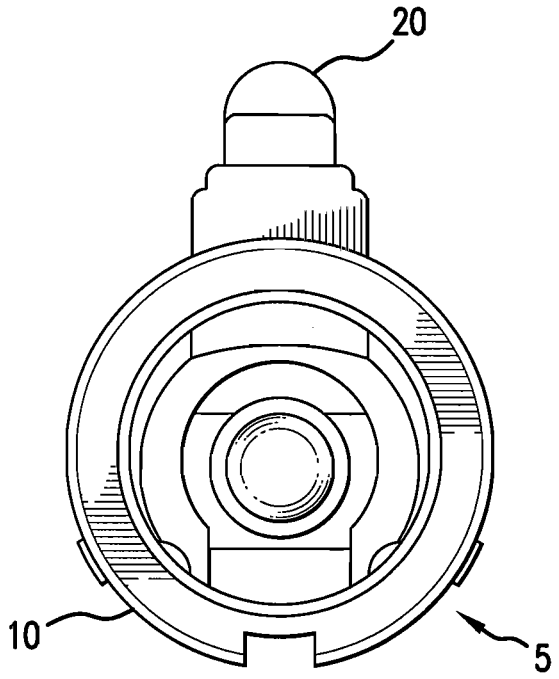
FIG. 12 is a front elevation view of the bolt carrier Assembly with the gas key mounted thereon.
Figure 13:
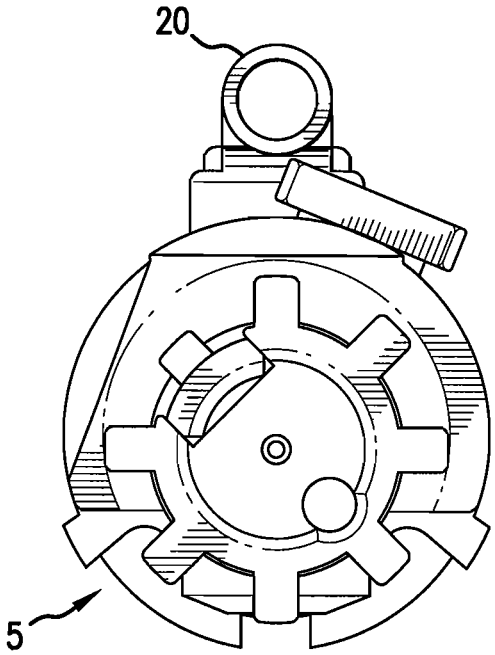
FIG. 13 is a rear elevation view of the bolt carrier assembly with the gas key mounted thereon.
Figure 14:
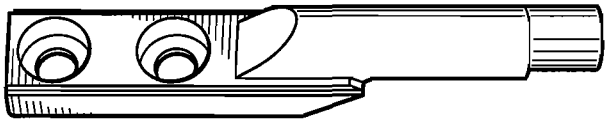
FIG. 14 is a top perspective view of a typical unmounted gas key.

In a bolt carrier assembly 5, the gas key 20 is fastened using two hex bolts 30 to the bolt carrier barrel 10. The gas key 20 has a fore hex bolt receiving hole 40 and an aft hex bolt receiving hole 50. Each hex bolt receiving hole 40 and 50, respectively, is of a diameter and depth so that the head of the fore hex bolt 70 and the head of the aft hex bolt 80 is completely recessed into each hex bolt receiving hole 40 and 50, respectively. The gas key 20 is bolted to the top of the bolt carrier barrel 10 using two hex bolt fasteners 30. The gas key 20 is fabricated with a keyway channel 60 cut across it in the area between the fore hex bolt receiving hole 40 and the aft hex bolt receiving hole 50. The walls of the keyway channel 60 preferably taper outwardly from the top of the gas key 20 and have a trapezoidal cross-section. In the preferred embodiment, the keyway channel 60 is wide enough at its base so that the keyway channel 60 may cut into the fore hex bolt receiving hole 40 and the aft hex bolt receiving hole 50. In alternate embodiments, the keyway channel 60 need not cut into either hex bolt receiving hole and may have a cross-section other than trapezoidal so long as the key element is well secured in the gas key, even against substantial forces resulting from the fire arm firing action. In yet another alternate embodiment, the keyway channel 60 may cut into only one of the hex bolt receiving holes.

To prevent separation or lifting of the gas key 20 from the bolt carrier barrel 10 due to loosening of the hex bolt fasteners 30, the key element 90 is set snuggly into the keyway channel 60. The key element 90 may be preferably somewhat "T" shaped and may comprise of a stem 100 and a rail 110. The stem 100 may have a stem fore edge 120 and a stem aft edge 130. The rail 110 may comprise a rail top 140 and a rail bottom 150. In the preferred embodiment, the stem 100 of the key element 90 is preferably trapezoidal in shape so that pressure exerted to the rail bottom 150 by one or both of the fasteners 30 causes the stem fore edge 120 and stem aft edge 130 to exert pressure on the keyway channel 60 to keep the hex bolt fasteners 30 from backing out of the fastener receiving holes 40 and 50, thus preventing the gas key 20 from separating from the bolt carrier barrel 10.

While the invention has been described and shown in substantial detail, many modifications and changes can be made in the structure disclosed without departing from the scope and spirit of the invention. The invention should not be limited of the exact structure disclosed.

The invention claimed is:

1. A bolt carrier assembly for a firearm, said assembly comprising:

a bolt carrier barrel arranged for reciprocal movement in said firearm, a gas key adapted to move with said barrel, fastener means attaching said gas key to said barrel, a keyway in said gas key, and a key element in said keyway, said key element overlying said fastener means, said key element adapted to retain said gas key in place during movement of said bolt carrier barrel on said firearm.

2. The bolt carrier assembly recited in claim 1, wherein said gas key is seated on one side of said bolt carrier barrel, and said fastener means is accessible on one side of said gas key remote from said barrel assembly.

3. The bolt carrier assembly recited in claim 2, wherein said gas key has recess means on said side for receiving said fastener means.

4. The bolt carrier assembly recited in claim 3, wherein said fastener means and said gas key have corresponding structure for retaining said fastener in said gas key.

5. The bolt carrier assembly recited in claim 1, wherein said keyway in said gas key has a niche for receiving said key element.

6. The bolt carrier assembly recited in claim 5, wherein said keyway and said key element have corresponding shapes adapted to seat said key element in said gas key niche.

7. The bolt carrier assembly recited in claim 6, wherein said key element and said keyway are trapezoidal in shape.

8. The bolt carrier assembly recited in claim 6, wherein said trapezoidal shape on a side closest to said barrel is wider than on a side remote from said barrel.

9. The bolt carrier assembly recited in claim 1, wherein said key element has a stem adapted for seating in said keyway and rail extending from said stem adapted for seating over said fastener means.

10. A gas key for a fire arm adapted for reciprocal movement responsive to firing said fire arm, said gas key comprising, receiving holes for receiving fasteners, said fasteners attaching said gas key to said fire arm, a keyway in said gas key, said keyway adapted to receive a key element, wherein said key element is adapted to be removably seated in said keyway, said key element is adapted to overlie said fastener means, said key element is adapted to secure said gas key in place on said fire arm, and said key element is selectively removable from said fire arm.

11. The gas key recited in claim 10, wherein said key element comprises a stem adapted for securement in said keyway and a rail extending from said stem adapted to overlay said gas key.

12. The gas key recited in claim 10, wherein said key element stem and said keyway have corresponding shapes.

* * * * *